US007818982B2

(12) United States Patent
Prickett

(10) Patent No.: US 7,818,982 B2
(45) Date of Patent: Oct. 26, 2010

(54) STAIN MASKING CUT RESISTANT GLOVES AND PROCESSES FOR MAKING SAME

(75) Inventor: Larry John Prickett, Chesterfield, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 871 days.

(21) Appl. No.: 11/545,740

(22) Filed: Oct. 10, 2006

(65) Prior Publication Data

US 2008/0083047 A1 Apr. 10, 2008

(51) Int. Cl.
*D04B 9/58* (2006.01)

(52) U.S. Cl. ..... 66/174; 2/16

(58) Field of Classification Search ..... 66/174, 66/171, 202; 2/16, 159, 167, 61.6
See application file for complete search history.

(56) References Cited

U.S. PATENT DOCUMENTS

| | | | | |
|---|---|---|---|---|
| 3,047,455 | A | 7/1962 | Holmes et al. | |
| 3,063,966 | A | 11/1962 | Kwolek at al. | |
| 3,767,756 | A | 10/1973 | Blades | |
| 3,869,429 | A | 3/1975 | Blades | |
| 3,869,430 | A | 3/1975 | Blades | |
| 4,457,985 | A | 7/1984 | Harpell et al. | |
| 4,918,912 | A * | 4/1990 | Warner | 57/255 |
| 4,994,323 | A | 2/1991 | Lee | |
| 5,114,652 | A | 5/1992 | Lee | |
| 5,525,700 | A | 6/1996 | Samuels et al. | |
| 5,685,014 | A * | 11/1997 | Dapsalmon | 2/16 |
| 5,891,813 | A | 4/1999 | Gadoury | |
| 5,925,149 | A | 7/1999 | Pacifici et al. | |
| 6,367,290 | B2 * | 4/2002 | Kolmes et al. | 66/172 R |
| 6,807,681 | B2 * | 10/2004 | Sorrels | 2/21 |
| 7,007,308 | B1 * | 3/2006 | Howland et al. | 2/161.6 |
| 2002/0106956 | A1 | 8/2002 | Howland | |
| 2004/0025486 | A1 | 2/2004 | Takiue | |
| 2004/0235383 | A1 | 11/2004 | Perry et al. | |

FOREIGN PATENT DOCUMENTS

| | | |
|---|---|---|
| JP | 2000-290849 | 10/2000 |
| JP | 2000290849 A * | 10/2000 |
| WO | WO 03/016604 | 2/2003 |

OTHER PUBLICATIONS

Anonymous: Perfect Fit—Hand Protection, Catalog 2005/2006, Internet Article, Mar. 24, 2006 XP002472667, Retrieved from the Internet.

Anonymous: Wells Lamont Industry Group—Protective Glove Sourcebook, Internet Article, Feb. 9, 2006, XP002472668, Retrieved from the Internet.

* cited by examiner

*Primary Examiner*—Danny Worrell

(57) ABSTRACT

This invention also relates to stain-masking cut resistant gloves and methods for making the same, the gloves comprising at least one aramid fiber and at least one lubricating fiber selected from the group consisting of aliphatic polyamide fiber, polyolefin fiber, polyethylene fiber, acrylic fiber, and mixtures thereof; wherein up to and including 15 parts by weight of the total amount of fibers in the glove are provided with a dye or pigment such that they have a color different from the remaining fibers; the dye or pigment selected such that the colored fibers have a measured "L" value that is lower than the measured "L" value for the remaining fibers.

7 Claims, 4 Drawing Sheets

STAIN MASKING CUT RESISTANT GLOVES AND PROCESSES FOR MAKING SAME

BACKGROUND OF THE INVENTION

1. Field of the Invention

This invention relates to cut resistant gloves having improved stain-masking and methods of making the same.

2. Description of Related Art

U.S. Pat. No. 5,925,149 to Pacifici, et al., discloses a fabric made with dyed nylon fibers that have been treated with a stain-blocker woven into a fabric with untreated nylon fibers followed by dyeing of the untreated nylon fibers in a second dyeing operation.

United States Patent Application Publication US 2004/0235383 to Perry, et al., discloses a yarn or fabric useful in protective garments designed for activities where exposure to molten substance splash, radiant heat, or flame is likely to occur. The yarn or fabric is made of flame resistant fibers and micro-denier flame resistant fibers. The weight ratio of the flame resistant fibers to the micro-denier flame resistant fibers is in the range of 4-9:2-6.

United States Patent Application Publication US 2002/0106956 to Howland discloses fabrics formed from intimate blends of high-tenacity fibers and low-tenacity fibers wherein the low-tenacity fibers have a denier per filament substantially below that of the high tenacity fibers.

United States Patent Application Publication US 2004/0025486 to Takiue discloses a reinforcing composite yarn comprising a plurality of continuous filaments and paralleled with at least one substantially non-twisted staple fiber yarn comprising a plurality of staple fibers. The staple fibers are preferably selected from nylon 6 staple fibers, nylon 66 staple fibers, meta-aromatic polyamide staple fibers, and para-aromatic polyamide staple fibers.

Gloves made from para-aramid fibers have excellent cut performance and command a premium price in the marketplace; however, para-aramid fibers naturally have a bright golden color that easily shows stains, giving an undesirable appearance after only a few uses. This affects the overall value of the gloves in some cut resistant applications because they can require more laundering; in some cases the articles give the appearance of being past their useful life when in fact they can still provide good cut resistance. Any improvement, therefore, in the masking of stains is desired especially if such improvement can be combined with other improvements that provide better comfort, durability, and/or a reduction of the amount of aramid fiber needed for a particular level of cut resistance.

BRIEF SUMMARY OF THE INVENTION

The invention relates to a stain-masking cut resistant glove comprising a) at least one aramid fiber, and b) at least one fiber selected from the group consisting of aliphatic polyamide fiber, polyolefin fiber, polyester fiber, acrylic fiber, and mixtures thereof;

wherein up to and including 15 parts by weight of the total amount of fibers in the glove are provided with a dye or pigment such that they have a color different from the remaining fibers; the dye or pigment selected such that the colored fibers have a measured "L" value that is lower than the measured "L" value for the remaining fibers.

The invention further relates to a process for making a stain-masking cut resistant glove, comprising:

a) blending i) at least one aramid fiber and ii) at least one fiber selected from the group consisting of aliphatic polyamide fiber, polyolefin fiber, polyethylene fiber, acrylic fiber, and mixtures thereof;

wherein up to and including 15 parts by weight of the total amount of fibers in the blend are provided with a dye or pigment such that they have a color different from the remaining fibers; the dye or pigment selected such that the colored fibers have a measured "L" value that is lower than the measured "L" value for the remaining fibers;

b) forming a spun staple yarn from the blend of fibers; and c) knitting a glove from the spun staple yarn.

DETAILED DESCRIPTION OF THE INVENTION

Figure 1:
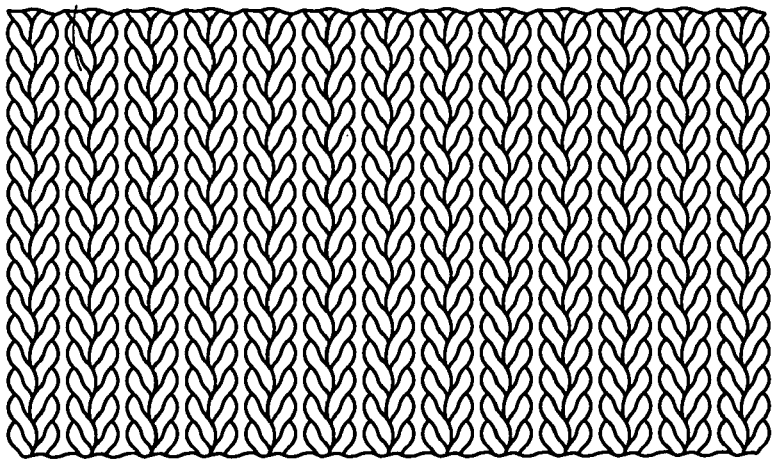
FIG. 1 is a representation of one possible knitted fabric type used in the glove of this invention.

Para-aramid fiber, such as Kevlar® brand para-aramid fiber available from E. I. du Pont de Nemours and Company, Wilmington, Del., is desired in fabrics and articles including gloves for its superior cut protection and many users look for the golden color of the para-aramid yarn as evidence that the articles have the cut resistant fiber. However, this golden color also easily shows stains giving the articles an undesirable appearance. Surprisingly, it has been found that the addition of only a small amount of dyed or pigmented fiber can mask the appearance of stains while still allowing some of the natural golden color of the aramid fiber to show through.

In some embodiments the gloves of this invention have even more benefits, including having cut resistance equivalent to or greater than a glove made with commonly use 100% 1.5 denier per filament (1.7 dtex per filament) para-aramid fiber yarns. In other words, in some embodiments the cut resistance of a 100% para-aramid fiber fabric can be duplicated by a fabric having lesser amounts of para-aramid fiber. In these embodiments it is believed a combination of different types of fibers, namely lubricating fiber, higher denier-per-filament aramid fiber, lower denier-per-filament aramid fiber, and colored fiber work together to provide not only stain-masking and cut resistance but also improved fabric abrasion resistance and flexibility, which translates to improved durability and comfort in use.

As used herein, the word "fabric" is meant to include any woven, knitted, or non-woven layer structure or the like that utilizes yarns. By "yarn" is meant an assemblage of fibers spun or twisted together to form a continuous strand. As used herein, a yarn generally refers to what is known in the art as a singles yarn, which is the simplest strand of textile material suitable for such operations as weaving and knitting. A spun staple yarn can be formed from staple fibers with more or less twist; a continuous multifilament yarn can be formed with or without twist. When twist is present, it is all in the same direction. As use herein the phrases "ply yarn" and "plied yarn" can be used interchangeably and refer to two or more yarns, i.e., singles yarns, twisted or plied together. "Woven" is meant to include any fabric made by weaving; that is, interlacing or interweaving at least two yarns typically at right angles. Generally such fabrics are made by interlacing one set of yarns, called warp yarns, with another set of yarns, called weft or fill yarns. The woven fabric can have essentially any weave, such as, plain weave, crowfoot weave, basket weave, satin weave, twill weave, unbalanced weaves, and the like. Plain weave is the most common. "Knitted" is meant to include a structure producible by interlocking a series of loops of one or more yarns by means of needles or wires, such as warp knits (e.g., tricot, milanese, or raschel) and weft knits (e.g., circular or flat). "Non-woven" is meant to include a network of fibers forming a flexible sheet material producible without weaving or knitting and held together by either (i) mechanical interlocking of at least some of the fibers, (ii) fusing at least some parts of some of the fibers, or (iii) bonding at least some of the fibers by use of a binder material. Non-woven fabrics that utilize yarns include primarily unidirectional fabrics. However, other structures are possible.

In some preferred embodiments, the gloves of this invention comprise a knitted fabric, using any appropriate knit pattern and conventional knitting machines. FIG. 1 is a representation of a knitted fabric. Cut resistance and comfort are affected by tightness of the knit and that tightness can be adjusted to meet any specific need. A very effective combination of cut resistance and comfort has been found in for example, single jersey knit and terry knit patterns. In some embodiments, gloves of this invention have a basis weight in the range of 3 to 30 oz/yd$^2$ (100 to 1000 g/m$^2$), preferably 5 to 25 oz/yd$^2$ (170 to 850 g/m$^2$), the gloves at the high end of the basis weight range providing more cut protection.

Figure 2:
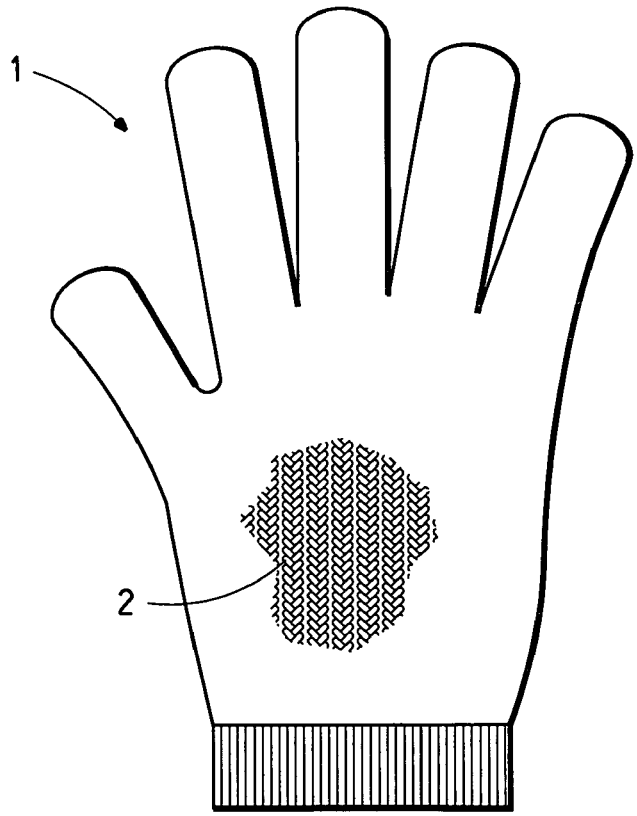
FIG. 2 is a representation of one possible knitted glove of this invention.

The gloves of this invention can be utilized to provide cut protection. FIG. 2 is a representation of one such knitted glove 1 having a detail 2 illustrating the knitted construction of the glove.

In one embodiment, this invention relates to a stain-masking cut resistant glove comprising at least one aramid fiber and at least one fiber selected from the group consisting of aliphatic polyamide fiber, polyolefin fiber, polyester fiber, acrylic fiber and mixtures thereof; wherein up to and including 15 parts by weight of the total amount of fibers in the glove are provided with a dye or pigment such that they have a color different from the remaining fibers; the dye or pigment selected such that the colored fibers have a measured "L" value that is lower than the measured "L" value for the remaining fibers.

In some preferred embodiments, the gloves of this invention comprise a stain-masking cut resistant fabric comprising a yarn comprising an intimate blend of staple fibers, the blend comprising 20 to 50 parts by weight of a lubricating fiber, 20 to 40 parts by weight of a first aramid fiber having a linear density of from 3.3 to 6 denier per filament (3.7 to 6.7 dtex per filament), 20 to 40 parts by weight of a second aramid fiber having a linear density of from 0.50 to 4.5 denier per filament (0.56 to 5.0 dtex per filament), and 2 to 15 parts by weight of a third aramid fiber having a linear density of from 0.5 to 2.25 denier per filament (0.56 to 2.5 dtex per filament), based on the total weight of the lubricating and first, second and third aramid fibers. The difference in filament linear density of the first aramid fiber to the second aramid fiber is 1 denier per filament (1.1 dtex per filament) or greater, and the third aramid fiber is provided with a color different from that of the first or second aramid fibers. In some preferred embodiments, the lubricating fiber and the first and second aramid fibers are each present individually in amounts ranging from about 26 to 40 parts by weight, based on 100 parts by weight of these fibers. In some preferred embodiments, the third aramid fiber is present in an amount of 3 to 12 parts by weight.

Figure 3:
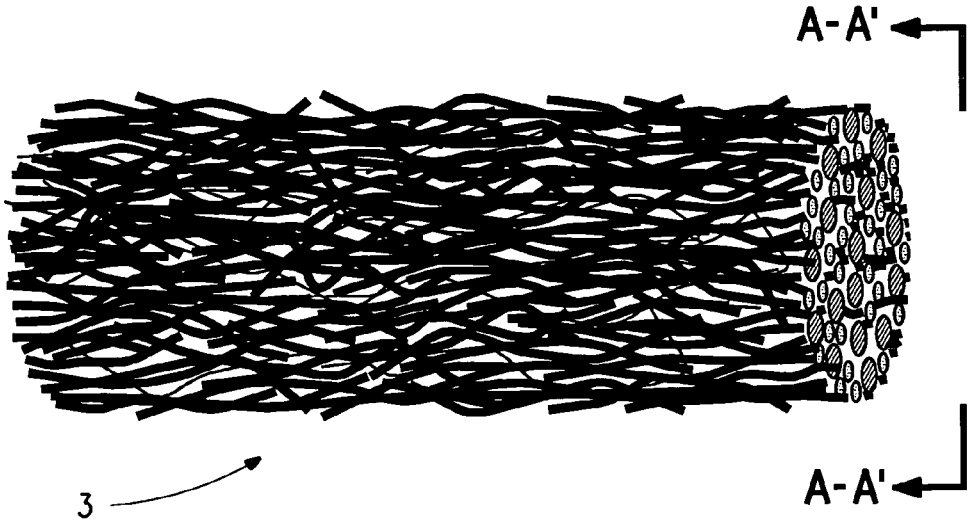
FIG. 3 is a representation of a section of staple fiber yarn comprising one possible intimate blend of fibers.

In some embodiments of this invention, the difference in filament linear density of the first (higher) denier-per-filament aramid fiber and the second (lower) denier-per-filament aramid fiber is 1 denier per filament (1.1 dtex per filament) or greater. In some preferred embodiments, the difference in filament linear density is 1.5 denier per filament (1.7 dtex per filament) or greater. It is believed the lubricating fiber reduces the friction between fibers in the staple yarn bundle, allowing the lower denier-per-filament aramid fiber and the higher denier-per-filament aramid fiber to more easily move in the fabric yarn bundles. FIG. 3 is a representation of a section of staple fiber yarn 3 comprising one possible intimate blend of fibers.

Figure 4:
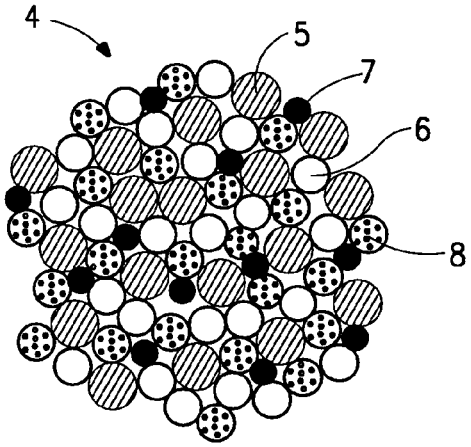
FIG. 4 is an illustration of one possible cross section of a staple yarn bundle useful in the gloves of this invention.

FIG. 4 is one possible embodiment of a cross-section A-A' of the staple fiber yarn bundle of FIG. 3. The staple fiber yarn 4 contains a first aramid fiber 5 having a linear density of from 3.3 to 6 denier per filament (3.7 to 6.7 dtex per filament), a second aramid fiber 6 having a linear density of from 0.50 to 4.5 denier per filament (0.56 to 5.0 dtex per filament) and a third aramid fiber 7 provided with color and having a linear density of 0.5 to 2.25 denier per filament (0.56 to 2.5 dtex per filament). Lubricating fiber 8 has a linear density in the same range as the second aramid fiber 6. The lubricating fiber is uniformly distributed in the yarn bundle and in many instances acts as to separate the first and second aramid fibers. It is thought this helps avoid substantial interlocking of any aramid fibrils (not shown) that can be present or generated from wear on the surface of aramid fibers and also provides a lubricating effect on the filaments in the yarn bundle, providing fabrics made from such yarns with a more textile fiber character and better aesthetic feel or "hand".

Figure 5:
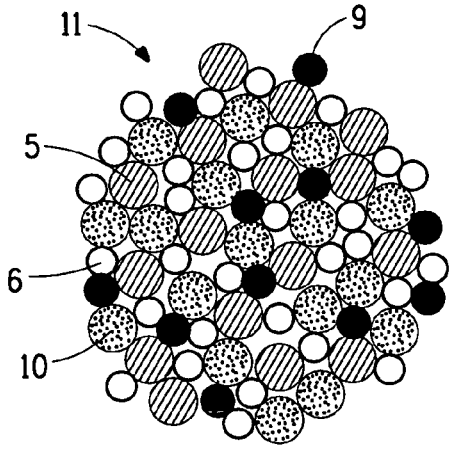
FIG. 5 is an illustration of another possible cross section of a staple yarn bundle useful in the gloves of this invention.
Figure 6:
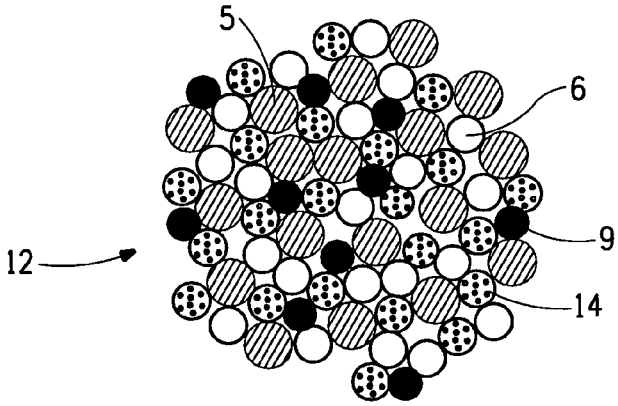
FIG. 6 is an illustration of another possible cross section of a staple yarn bundle useful in the gloves of this invention.
Figure 7:
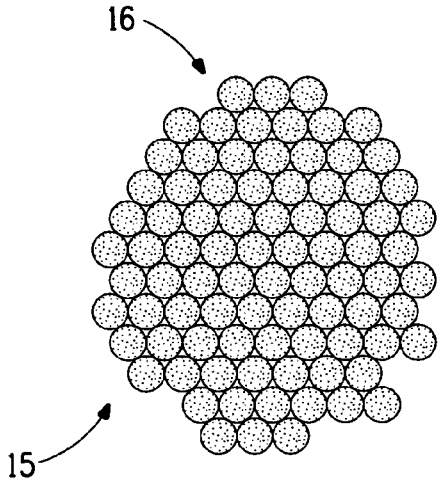
FIG. 7 is an illustration of the cross section of a prior art staple yarn bundle having commonly used 1.5 denier per filament (1.7 dtex per filament) para-aramid fiber.

FIG. 5 illustrates another possible embodiment of a cross-section A-A' of the staple fiber yarn bundle of FIG. 3. Yarn bundle 11 has the same first and second aramid fibers 5 and 6 as FIG. 4 however the third colored aramid fiber 9 has the same denier as the second aramid fiber and lubricating fiber 10 has a linear density of in the same range as the first aramid fiber 5. FIG. 6 illustrates another possible embodiment of a cross-section A-A' of the staple fiber yarn bundle of FIG. 3. Yarn bundle 12 has the same first, second, and third aramid fibers 5, 6, and 9 as FIG. 5 however the lubricating fiber 14 has a linear density of in the same range as the second aramid fiber 6. In comparison, FIG. 7 is an illustration of a cross-section of the yarn bundle of a commonly-used prior art 1.5 denier per filament (1.7 dtex per filament) para-aramid staple yarn 15 with 1.5 denier per filament (1.7 dtex per filament) fibers 16.

Figure 8:
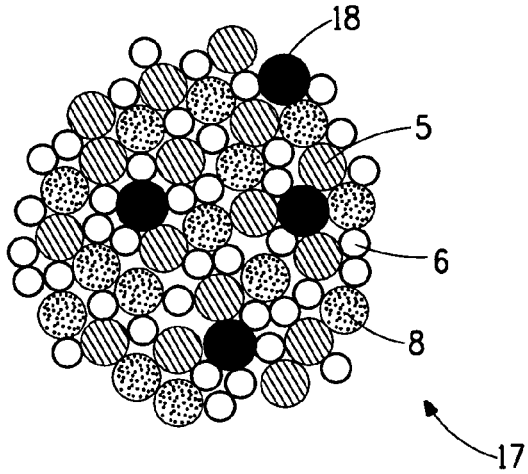
FIG. 8 is an illustration of another possible cross section of a staple yarn bundle useful in the gloves of this invention.

FIG. 8 illustrates a possible embodiment of a cross-section A-A' of the staple fiber yarn bundle of FIG. 3. Yarn bundle 17 has the same first and second aramid fibers 5 and 6 and fiber 10 selected from the group consisting of aliphatic polyamide fiber, polyolefin fiber, polyester fiber, acrylic fiber and mixtures thereof that has the same denier as the first aramid fiber 5 as in FIG. 5. However, present in this yarn bundle is colored fiber 18, which in this illustration has a linear density in the same range as either the first aramid fiber 5 or fiber 10. The colored fiber 18 is provided with a dye or pigment and can be an aramid fiber, however, in some applications, a dyed or pigmented lubricating fiber could be used. In some embodiments the dyed or pigmented fibers have a lower denier per filament than any of the undyed aramid fibers or other fibers. For simplicity in the figures, in those instances where the lubricating fiber is said to be roughly the same denier as an aramid fiber type, it is shown having the same diameter as that aramid fiber type. The actual fiber diameters may be slightly different due to differences in the lubricating fiber polymer and aramid polymer densities. While in all of these figures the individual fibers are represented as having a round cross section, and that many of the fibers useful in these bundles preferably can have a round, oval or bean cross-sectional shape, it is understood that fibers having other cross sections can be used in these bundles.

Figure 9:
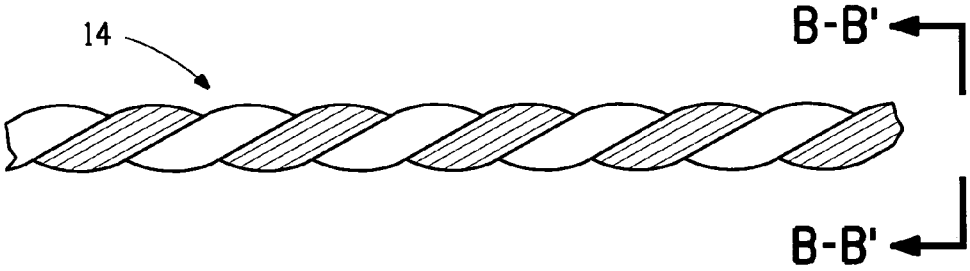
FIG. 9 is an illustration of a one possible ply yarn made from two singles yarns.
Figure 10:
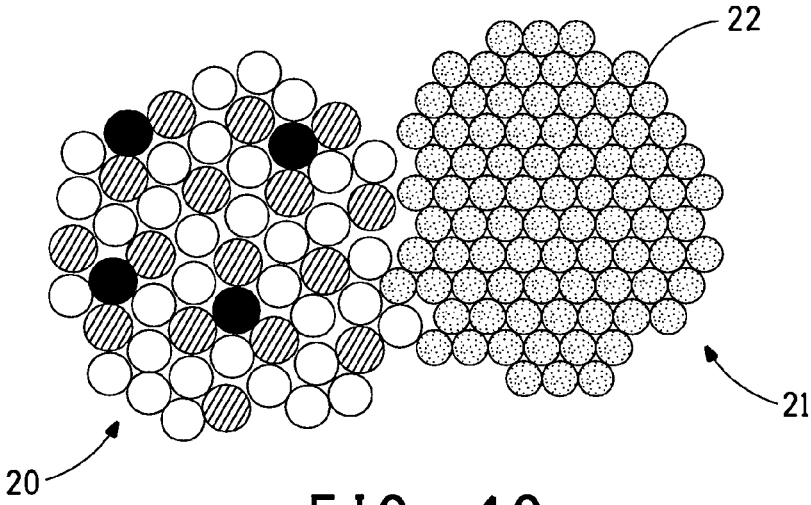
FIG. 10 is an illustration of one possible cross section of a ply yarn made from two different singles yarns.

While in the figures these bundles of fibers represent singles yarns, it is understood these multidenier singles yarns can be plied with one or more other singles yarns to make plied yarns. For example, FIG. 9 is an illustration of one embodiment of a ply- or plied-yarn 19 made from ply-twisting two singles yarns together. FIG. 10 is one possible embodiment of a cross-section B-B' of the ply yarn bundle of FIG. 9 containing two singles yarns, with one singles yarn 20 made from an intimate blend of multidenier staple fibers as described previously for FIG. 6 and one singles yarn 21 made from only one type of filaments 22.

Figure 11:
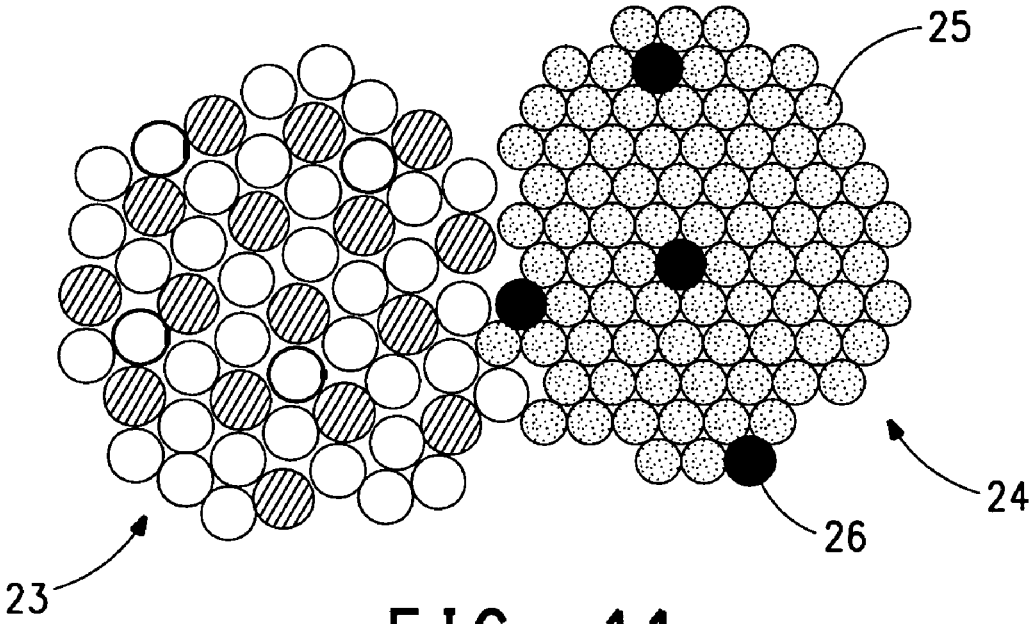
FIG. 11 is an illustration of one possible cross section of a ply yarn made from two different singles yarns.

FIG. 11 is another possible embodiment of a cross-section B-B' of the ply yarn bundle of FIG. 9 containing two singles yarns, with one singles yarn 23 made from an intimate blend of multidenier staple fibers as described previously in FIG. 6 however without any colored fibers, and one singles yarn 24 made from another fiber 25 and a colored fiber 26. As should be evident from these figures, the small percentage of colored fiber in a plied yarn could be in any or all of the singles yarns that make up the plied yarn.

Figure 12:
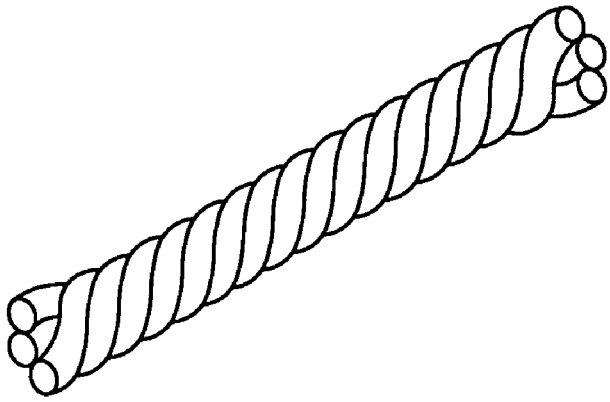
FIG. 12 is an illustration of one possible ply yarn made from three singles yarns.

While only two different singles are shown in these figures, this is not restrictive and it should be understood the ply yarn could contain more than two yarns ply-twisted together. For example, FIG. 12 is an illustration of three singles yarns ply-twisted together. It should also be understood the ply yarn can be made from two or more singles yarns made from an intimate blend of multidenier staple fibers as described previously, or the ply yarn can be made from at least one of the singles yarn made from an intimate blend of multidenier staple fibers and at least one yarn having any desired composition, including for example a yarn comprising continuous filament.

The color of fabrics and gloves can be measured using a spectrophotometer also called a colorimeter, which provides three scale values "L", "a", and "b" representing various characteristics of the color of the item measured. On the color scale, lower "L" values generally indicate a darker color, with the color white having a value of about 100 and black having a color of about 0. New or clean natural or undyed para-aramid fiber has a bright golden color that when measured using a colorimeter has a "L" value in the range of 80 to 90. In one embodiment, it has been found that if up to and including 15 parts by weight of the fibers in a glove are replaced with pigmented or dyed fibers such that the glove fabric has a "L" value of approximately 50 to 70 the glove is perceived to look less dirty and to mask stains while retaining some hues of the golden aramid fiber, indicating the glove contains the desired cut resistant fiber. As fewer fibers are used or as the shade of the fibers is changed such that the "L" value of the glove fabric approaches that of a glove fabric containing solely undyed or unpigmented fibers the ability to mask stains is reduced. Further, excessively dark shades having an "L" value of less than 50 are less desirable because the gloves totally lose their golden color "signature" indicating the presence of aramid fibers.

In some embodiments, the cut resistant gloves of this invention comprise a yarn comprising an intimate blend of staple fibers. By intimate blend it is meant the various staple fibers are distributed homogeneously in the staple yarn bundle. The staple fibers used in some embodiments of this invention have a length of 2 to 20 centimeters. The staple fibers can be spun into yarns using short-staple or cotton-based yarn systems, long-staple or woolen-based yarn systems, or stretch-broken yarn systems. In some embodiments the staple fiber cut length is preferably 3.5 to 6 centimeters, especially for staple to be used in cotton based spinning systems. In some other embodiments the staple fiber cut length is preferably 3.5 to 16 centimeters, especially for staple to be used in long staple or woolen based spinning systems. The staple fibers used in many embodiments of this invention have a diameter of 5 to 30 micrometers and a linear density in the range of about 0.5 to 6.5 denier per filament (0.56 to 7.2 dtex per filament), preferably in the range of 1.0 to 5.0 denier per filament (1.1 to 5.6 dtex per filament).

"Lubricating fiber" as used herein is meant to include any fiber that, when used with the multidenier aramid fiber in the proportions designated herein to make a yarn, increases the flexibility of fabrics or articles (including gloves) made from that yarn. It is believed that the desired effect provided by the lubricating fiber is associated with the non-fibrillating and yarn-to-yarn frictional properties of the fiber polymer. Therefore, in some preferred embodiments the lubricating fiber is a non-fibrillating or "fibril-free" fiber. In some embodiments the lubricating fiber has a yarn-on-yarn dynamic friction coefficient, when measured on itself, of less than 0.55, and in some embodiments the dynamic friction coefficient is less than 0.40, as measured by the ASTM Method D3412 capstan method at 50 grams load, 170 degree wrap angle, and 30 cm/second relative movement. For example, when measured in this manner, polyester-on-polyester fiber has a measured dynamic friction coefficient of 0.50 and nylon-on-nylon fiber has a measured dynamic friction coefficient of 0.36. It is not necessary that the lubricant fiber have any special surface finish or chemical treatment to provide the lubricating behavior. Depending on the desire aesthetics of the final glove, the lubricating fiber can have a filament linear density equal to filament linear density of one of the aramid fiber types in the yarn or can have a filament linear density different from filament linear densities of the aramid fibers in the yarn.

In some preferred embodiments of this invention, the lubricating fiber is selected from the group of aliphatic polyamide fiber, polyolefin fiber, polyester fiber, acrylic fiber and mixtures thereof. In some embodiments the lubricating fiber is a thermoplastic fiber. "Thermoplastic" is meant to have its traditional polymer definition; that is, these materials flow in the manner of a viscous liquid when heated and solidify when cooled and do so reversibly time and time again on subsequent heatings and coolings. In some most preferred embodiments the lubricating fiber is a melt-spun or gel-spun thermoplastic fiber.

In some preferred embodiments aliphatic polyamide fiber refers to any type of fiber containing nylon polymer or copolymer. Nylons are long chain synthetic polyamides having recurring amide groups (—NH—CO—) as an integral part of the polymer chain, and two common examples of nylons are nylon 66, which is polyhexamethylenediamine adipamide, and nylon 6, which polycaprolactam. Other nylons can include nylon 11, which is made from 11-amino-undecanoic acid; and nylon 610, which is made from the condensation product of hexamethylenediamine and sebacic acid.

In some embodiments, polyolefin fiber refers to a fiber produced from polypropylene or polyethylene. Polypropylene is made from polymers or copolymers of propylene. One polypropylene fiber is commercially available under the trade name of Marvess® from Phillips Fibers. Polyethylene is made from polymers or copolymers of ethylene with at least 50 mole percent ethylene on the basis of 100 mole percent polymer and can be spun from a melt; however in some preferred embodiments the fibers are spun from a gel. Useful polyethylene fibers can be made from either high molecular weight polyethylene or ultra-high molecular weight polyethylene. High molecular weight polyethylene generally has a weight average molecular weight of greater than about 40,000. One high molecular weight melt-spun polyethylene fiber is commercially available from Fibervisions®; polyolefin fiber can also include a bicomponent fiber having various polyethylene and/or polypropylene sheath-core or side-by-side constructions. Commercially available ultra-high molecular weight polyethylene generally has a weight average molecular weight of about one million or greater. One ultra-high molecular weight polyethylene or extended chain polyethylene fiber can be generally prepared as discussed in U.S. Pat. No. 4,457,985. This type of gel-spun fiber is commercially available under the trade names of Dyneema® available from Toyobo and Spectra® available from Honeywell.

In some embodiments, polyester fiber refers to any type of synthetic polymer or copolymer composed of at least 85% by weight of an ester of dihydric alcohol and terephthalic acid. The polymer can be produced by the reaction of ethylene glycol and terephthalic acid or its derivatives. In some embodiments the preferred polyester is polyethylene terephthalate (PET). Polyester formulations may include a variety of comonomers, including diethylene glycol, cyclohexanedimethanol, poly(ethylene glycol), glutaric acid, azelaic acid, sebacic acid, isophthalic acid, and the like. In addition to these comonomers, branching agents like trimesic acid, pyromellitic acid, trimethylolpropane and trimethyloloethane, and pentaerythritol may be used. PET may be obtained by known polymerization techniques from either terephthalic acid or its lower alkyl esters (e.g., dimethyl terephthalate) and ethylene glycol or blends or mixtures of these. Useful polyesters can also include polyethylene napthalate (PEN). PEN may be obtained by known polymerization techniques from 2,6 napthalene dicarboxylic acid and ethylene glycol.

In some other embodiments the preferred polyesters are aromatic polyesters that exhibit thermotropic melt behavior. These include liquid crystalline or anisotropic melt polyesters such as available under the tradename of Vectran® available from Celanese. In some other embodiments fully aromatic melt processable liquid crystalline polyester polymers having low melting points are preferred, such as those described in U.S. Pat. No. 5,525,700.

In some embodiments, acrylic fiber refers to a fiber having at least 85 weight percent acrylonitrile units, an acrylonitrile unit being —(CH2—CHCN)—. The acrylic fiber can be made from acrylic polymers having 85 percent by weight or more of acrylonitrile with 15 percent by weight or less of an ethylenic monomer copolymerizable with acrylonitrile and mixtures of two or more of these acrylic polymers. Examples of the ethylenic monomer copolymerizable with acylonitrile include acylic acid, methacrylic acid and esters thereof (methyl acrylate, ethyl acrylate, methyl methacylate, ethyl methacrylate, etc.), vinyl acetate, vinyl chloride, vinylidene chloride, acrylamide, methacylamide, methacrylonitrile, allylsulfonic acid, methanesulfonic acid and styrenesulfonic acid. Acrylic fibers of various types are commercially available from Sterling Fibers, and one illustrative method of making acrylic polymers and fibers is disclosed in U.S. Pat. No. 3,047,455.

In some embodiments of this invention, the lubricating staple fibers have a cut index of at least 0.8 and preferably a cut index of 1.2 or greater. In some embodiments the preferred lubricating staple fibers have a cut index of 1.5 or greater. The cut index is the cut performance of a 475 grams/square meter (14 ounces/square yard) fabric woven or knitted from 100% of the fiber to be tested that is then measured by ASTM F1790-97 (measured in grams, also known as the Cut Protection Performance (CPP)) divided by the areal density (in grams per square meter) of the fabric being cut.

In some embodiments of this invention, the preferred aramid staple fibers are para-aramid fibers. By para-aramid fibers is meant fibers made from para-aramid polymers; poly (p-phenylene terephthalamide) (PPD-T) is the preferred para-aramid polymer. By PPD-T is meant the homopolymer resulting from mole-for-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as about 10 mole percent of the p-phenylene diamine or the terephthaloyl chloride, or perhaps slightly higher, provided only that the other diamines and diacid chlorides have no reactive groups which interfere with the polymerization reaction. PPD-T, also, means copolymers resulting from incorporation of other aromatic diamines and other aromatic diacid chlorides such as, for example, 2,6-naphthaloyl chloride or chloro- or dichloroterephthaloyl chloride; provided, only that the other aromatic diamines and aromatic diacid chlorides be present in amounts which do not adversely affect the properties of the para-aramid.

Additives can be used with the para-aramid in the fibers and it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride of the aramid.

Para-aramid fibers are generally spun by extrusion of a solution of the para-aramid through a capillary into a coagulating bath. In the case of poly(p-phenylene terephthalamide), the solvent for the solution is generally concentrated sulfuric acid and the extrusion is generally through an air gap into a cold, aqueous, coagulating bath. Such processes are well known and are generally disclosed in U.S. Pat. Nos. 3,063,966; 3,767,756; 3,869,429, & 3,869,430. Para-aramid fibers are available commercially as Kevlar® brand fibers, which are available from E. I. du Pont de Nemours and Company, and Twaron® brand fibers, which are available from Teijin, Ltd.

Any of the fibers discussed herein or other fibers that are useful in this invention can be provided with color using conventional techniques well known in the art that are used to dye or pigment those fibers. Alternatively, many colored fibers can be obtained commercially from many different vendors. One representative method of making colored aramid fibers is disclosed in U.S. Pat. Nos. 5,114,652 and 4,994,323 to Lee.

In some embodiments, this invention relates to processes for making a stain-masking cut resistant glove comprising the steps of blending at least one aramid fiber and at least one fiber selected from the group consisting of aliphatic polyamide fiber, polyolefin fiber, polyester fiber, acrylic fiber, and mixtures thereof, wherein up to and including 15 parts by weight of the total amount of fibers in the blend are provided with a dye or pigment such that they have a color different from the remaining fibers, the dye or pigment selected such that the colored fibers have a measured "L" value that is lower than the measured "L" value for the remaining fibers; forming a spun staple yarn from the blend of fibers; and knitting a glove from the spun staple yarn.

In some preferred embodiments, the intimate staple fiber blend is made by first mixing together staple fibers obtained from opened bales, along with any other staple fibers, if desired for additional functionality. The fiber blend is then formed into a sliver using a carding machine. A carding machine is commonly used in the fiber industry to separate, align, and deliver fibers into a continuous strand of loosely assembled fibers without substantial twist, commonly known as carded sliver. The carded sliver is processed into drawn sliver, typically by, but not limited to, a two-step drawing process.

Spun staple yarns are then formed from the drawn sliver using conventional techniques. These techniques include conventional cotton system, short-staple spinning processes, such as, for example, open-end spinning, ring-spinning, or higher speed air spinning techniques such as Murata air-jet spinning where air is used to twist the staple fibers into a yarn. The formation of spun yarns useful in the gloves of this invention can also be achieved by use of conventional woolen system, long-staple or stretch-break spinning processes, such as, for example, worsted or semi-worsted ring-spinning. Regardless of the processing system, ring-spinning is the generally preferred method for making cut-resistant staple yarns.

Staple fiber blending prior to carding is one preferred method for making well-mixed, homogeneous, intimate-blended spun yarns used in this invention, however other processes are possible. For example, the intimate fiber blend can be made by cutter blending processes; that is, the various fibers in tow or continuous filament form can be mixed together during or prior to crimping or staple cutting. This method can be useful when aramid staple fiber is obtained from a multidenier spun tow or a continuous multidenier multifilament yarn. For example, a continuous multifilament aramid yarn can be spun from solution through a specially-prepared spinneret to create a yarn wherein the individual aramid filaments have two or more different linear densities; the yarn can then be cut into staple to make a multidenier aramid staple blend. The lubricant and colored fibers can be combined with this multidenier aramid blend either by combining the lubricant and colored fibers with the aramid fiber and cutting them together, or by mixing lubricant and colored staple fibers with the aramid staple fiber after cutting. Another method to blend the fibers is by carded and/or drawn sliver-blending; that is, to make individual slivers of the various staple fibers in the blend, or combinations of the various staple fibers in the blend, and supplying those individual carded and/or drawn slivers to roving and/or staple yarn spinning devices designed to blend the sliver fibers while spinning the staple yarn. All of these methods are not intended to be limited and other methods of blending staple fibers and making yarns are possible. All of these staple yarns can contain other fibers as long as the desired glove attributes are not dramatically compromised.

The spun staple yarn of an intimate blend of fibers is then preferably fed to a knitting device to make a knitted glove. Such knitting devices include a range of very fine to standard gauge glove knitting machines, such as the Sheima Seiki glove knitting machine used in the examples that follow. If desired, multiple ends or yarns can be supplied to the knitting machine; that is, a bundle of yarns or a bundle of plied yarns can be co-fed to the knitting machine and knitted into a glove using conventional techniques. In some embodiments it is desirable to add functionality to the gloves by co-feeding one or more other staple or continuous filament yarns with one or more spun staple yarn having the intimate blend of fibers. The tightness of the knit can be adjusted to meet any specific need. A very effective combination of cut resistance and comfort has been found in for example, single jersey knit and terry knit patterns.

Test Methods

Color Measurement. The system used for measuring color is the 1976 CIELAB color scale (L-a-b system developed by the Commission Internationale de l'Eclairage). In the CIE "L-a-b" system, color is viewed as point in three dimensional space. The "L" value is the lightness cordinant with high values being the lightest, the "a" value is the red/green cordinant with "+a" indicating red hue and "−a" indicating green hue and the "b" value is the yellow/blue cordinant with "+b" indicating yellow hue and "−b" indicating blue hue. Spectrophotometers were used to measure the color for glove fabrics produced from the example yarn items. The GretagMacbeth Color-Eye 3100 spectrophotometer was used to measure some of the glove fabrics produced from the example yarn items in Table 2. The Hunter Lab UltraScan® PRO spectrophotometer was used to measure some of the glove fabrics produced from the example yarn items and used laundered gloves in Tables 2 and 4. The Datacolor 400™ spectrophotometer was used to measure some of the glove fabrics produced from the example yarn items in Table 3. All three spectrophotometers used the industry standard of 10-degree observer and D65 illuminant.

EXAMPLES

In the following examples, glove fabrics were knitted using staple fiber-based ring-spun yarns. The staple fiber blend compositions were prepared by blending various staple fibers of a type shown in the Table 1 in proportions as shown in Table 2. In all cases the aramid fiber was made from poly(paraphenylene terephthalamide) (PPD-T). This type of fiber is known under the trademark of Kevlar® brand fiber and was manufactured by E. I. du Pont de Nemours and Company and had L/a/b color values of approximately 85/−5.9/45. The lubricant fiber component was semi-dull nylon 66 fiber sold by Invista under the designation Type 420 and had L/a/b color values of approximately 91/−0.65/0.42. The colored aramid fibers were producer colored using spun-in pigments. The Royal Blue colored Kevlar® brand fiber had L/a/b color values of approximately 25/−5.2/−18. The producer colored black acrylic fiber was manufactured by CYDSA; this black fiber had a color similar to Black colored Kevlar® brand fiber, which had L/a/b color values of 19/−1.9/−2.7.

TABLE 1

| General Fiber Type | Specific Fiber Type | Linear Density denier/ filament | Linear Density dtex/ filament | Cut Length centimeters | Color |
|---|---|---|---|---|---|
| Aramid | PPD-T | 1.5 | 1.7 | 4.8 | Natural Gold |
| Aramid | PPD-T | 2.25 | 2.5 | 4.8 | Natural Gold |
| Aramid | PPD-T | 4.2 | 4.7 | 4.8 | Natural Gold |
| Lubricant | nylon | 1.7 | 1.9 | 3.8 | Natural White |
| Colored | acrylic | 3.0 | 3.3 | 4.8 | Black |
| Colored | PPD-T | 1.5 | 1.7 | 4.8 | Royal Blue |
| Colored | PPD-T | 1.5 | 1.7 | 4.8 | Black |

crimped tow was then cut into staple about 4.8 centimeters long to form an intimate blend of the three types of aramid fibers. Two parts by weight of the intimate blend of three aramid staple fibers were then staple blended with one part of nylon 66 fiber to form a final staple fiber blend. Each fiber blend for yarns 1 through 6 and A through D was then fed through a standard carding machine to make carded sliver.

The carded sliver was then drawn using two pass drawing (breaker/finisher drawing) into drawn sliver and processed on a roving frame. 6560 dtex (0.9 hank count) rovings were made for each of the items 1 through 5 and A through D. A 7380 dtex (0.8 hank count) roving was made for item 6. Yarns were then produced by ring-spinning two ends of each roving for compositions 1 through 5 and A through D. Yarn was produced by ring-spinning one end of each roving for composition 6. 10/1 s cotton count yarns were produced having a 3.10 twist multiplier for items 1 through 5 and A through D. A 16.5 s cotton count yarn was produced having a 3.10 twist multiplier for item 6. Each of the final 1 through 5 and A through D yarns were made by plying a pair of the 10/1 s yarns together with a balancing reverse twist to make 10/2 s yarns. The final item 6 yarn was made by plying a pair of the 16.5/1 s yarns together with a balancing reverse twist to make 16.5/2 s yarns.

The 10/2 s cc yarns and the 16.5/2 s cc yarns were knitted into glove fabric samples using a standard 7 gauge Sheima Seiki glove knitting machine. The machine knitting time was adjusted to produce glove bodies about one meter long to provide adequate fabric samples for subsequent cut testing. Fabric samples for items 1 through 5 and A through D were made by feeding 3 ends of 10/2 s to the glove knitting machine to yield glove fabric samples having a basis weight of about 20 oz/yd$^2$ (680 g/m$^2$). A glove fabric for item 6 was made by made by feeding 4 ends of 16.5/2 s to the glove knitting machine to yield fabric samples of about 16 oz/yd$^2$ (542 g/m$^2$). Standard size gloves were then made from each of the yarns having the same nominal basis weight as the fabrics. The fabrics were subjected to color testing and the results are presented below in Tables 3.

TABLE 2

| Fabric | 1.5 dpf Aramid Staple Fiber Weight % | 2.25 dpf Aramid Staple Fiber Weight % | 4.2 dpf Aramid Staple Fiber Weight % | Nylon 66 Thermoplastic Staple Fiber Weight % | Black Acrylic Thermoplastic Staple Fiber Weight % | Producer Colored Aramid Staple Fiber Weight % | Aramid Staple Fiber Color |
|---|---|---|---|---|---|---|---|
| A | 100 | 0 | 0 | 0 | 0 | 0 | None |
| 1 | 0 | 61.7 | 0 | 33.3 | 0 | 5 | Black |
| 2 | 0 | 61.7 | 0 | 33.3 | 0 | 5 | Blue |
| 3 | 0 | 56.7 | 0 | 33.3 | 0 | 10 | Black |
| 4 | 0 | 56.7 | 0 | 33.3 | 0 | 10 | Blue |
| 5 | 0 | 51.7 | 0 | 33.3 | 0 | 15 | Black |
| B | 0 | 80 | 0 | 0 | 20 | 0 | None |
| C | 0 | 70 | 0 | 0 | 30 | 0 | None |
| D | 0 | 60 | 0 | 0 | 40 | 0 | None |
| 6 | 0 | 28.4 | 33.3 | 33.3 | 0 | 5 | Black |

The yarns used to make the knitted glove fabrics were made in the following manner. For the control yarn A, approximately seven kilograms of a single type of PPD-T staple fiber was fed directly into a carding machine to make a carded sliver. Two to nine kilograms of each staple fiber blend composition for yarns 1 through 5 and comparison yarns B through D as shown in Table 2 were then made. These staple fiber blends were made by first hand-mixing the fibers and then feeding the mixture twice through a picker to make uniform fiber blends. Yarn 6 was produced by combining and three types of continuous aramid filaments in adequate amounts to make about 700 kilograms of crimped tow. The

TABLE 3

| Fabric | Method | L | A | B | Method | L | a | b | Method | L | a | b |
|---|---|---|---|---|---|---|---|---|---|---|---|---|
| A | CE-3100 | 84.54 | −5.86 | 44.73 | Hunter Lab | 84.97 | −5.81 | 44.19 | DataColor | 85.82 | −5.98 | 45.73 |
| 1 | CE-3100 | 65.42 | −7.72 | 21.86 | Hunter Lab | 65.75 | −7.53 | 21.03 | | | | |
| 2 | CE-3100 | 65.34 | −9.97 | 16.94 | Hunter Lab | 65.87 | −9.71 | 16.53 | | | | |
| 3 | CE-3100 | 60.07 | −7.71 | 17.57 | Hunter Lab | 60.88 | −7.54 | 17.36 | | | | |
| 4 | CE-3100 | 64.69 | −10.33 | 19.19 | Hunter Lab | 64.92 | −10.05 | 18.56 | | | | |
| 5 | CE-3100 | 55.44 | −7.44 | 13.03 | Hunter Lab | 55.47 | −6.93 | 12.28 | | | | |
| B | CE-3100 | 49.76 | −5.63 | 17.33 | | | | | | | | |
| C | CE-3100 | 44.41 | −5.77 | 13.26 | | | | | | | | |
| D | CE-3100 | 39.91 | −4.82 | 10.96 | | | | | | | | |
| 6 | | | | | | | | | DataColor | 65.77 | −7.98 | 22.15 |

A random sampling of 10 laundered 100% aramid fiber gloves that had been used by industrial workers handling sheet metal and having the designations "AA" through "BB" were tested for color and the results are presented below in Table 4. These gloves were darker in color than a new 100% aramid fiber glove (designate "A" in the table) and had varying degrees of stains that were not removed by laundering.

By comparing the color testing results of the laundered and stained gloves AA through BB in Table 4 with the color testing results of items 1 through 6 of Table 3, it is clear that by adding a small amount of colored fiber, the visual difference between a new glove and a used glove is reduced considerably. Gloves made from the compositions of items B through D from Table 3 are less desired because they are even in darker in color and do not allow for much of the base golden-yellow color of the aramid fiber to show through.

TABLE 4

| Glove | | L | a | b |
|---|---|---|---|---|
| A | Hunter Lab | 84.97 | −5.81 | 44.19 |
| Laundered AA | Hunter Lab | 73.38 | −4.85 | 23.48 |
| Laundered BB | Hunter Lab | 73.39 | −2.93 | 32.58 |
| Laundered CC | Hunter Lab | 73.55 | −2.91 | 33.35 |
| Laundered DD | Hunter Lab | 72.59 | −1.62 | 33.29 |
| Laundered EE | Hunter Lab | 75.22 | −0.82 | 40.08 |
| Laundered FF | Hunter Lab | 71.11 | −3.18 | 30.43 |
| Laundered GG | Hunter Lab | 76.26 | −2.07 | 36.19 |
| Laundered HH | Hunter Lab | 70.03 | −0.34 | 34.92 |
| Laundered II | Hunter Lab | 74.84 | −3 | 30.63 |
| Laundered JJ | Hunter Lab | 76.45 | −1.15 | 36.61 |

What is claimed is:

1. A stain-masking cut resistant glove comprising a) at least one pigmented or dyed aramid fiber, b) at least one aramid fiber having natural or undyed color, and c) at least one fiber selected from the group consisting of aliphatic polyamide fiber, polyolefin fiber, polyester fiber, acrylic fiber, and mixtures thereof;

wherein 2 to 15 parts by weight of the total amount of fibers in the glove are provided with a dye or pigment such that they have a color different from the remaining fibers; the dye or pigment selected such that the colored fibers have a measured "L" value that is lower than the measured "L" value for the remaining fibers.

2. The stain-masking cut resistant glove of claim 1, wherein the glove has an L value of 60 +/−10 units.

3. The stain-masking cut resistant glove of claim 1, wherein the glove has an L value of 60 +/−8 units.

4. The stain-masking cut resistant glove of claim 1, wherein the colored fibers and the remaining fibers are present as an intimate blend of staple fibers.

5. The stain-masking cut resistant glove of claim 1, wherein the colored fibers are present in a first yarn and the remaining fibers are present in one or more additional yarns.

6. The stain-masking cut resistant glove of claim 1, wherein the aramid fiber is poly(paraphenylene terephthalamide) fiber.

7. The glove of claim 1, wherein 3 to 12 parts by weight of the total amount of fibers in the glove is an aramid fiber provided with a dye or pigment.

* * * * *